US009793078B2

(12) United States Patent
Takahashi et al.

(10) Patent No.: US 9,793,078 B2
(45) Date of Patent: Oct. 17, 2017

(54) ELECTROMAGNETIC RELAY

(71) Applicant: FUJITSU COMPONENT LIMITED, Tokyo (JP)

(72) Inventors: Katsuyuki Takahashi, Tokyo (JP); Yoshinori Kurata, Tokyo (JP); Daishi Kitajima, Tokyo (JP)

(73) Assignee: FUJITSU COMPONENT LIMITED, Tokyo (JP)

( * ) Notice: Subject to any disclaimer, the term of this patent is extended or adjusted under 35 U.S.C. 154(b) by 0 days.

(21) Appl. No.: 14/609,506

(22) Filed: Jan. 30, 2015

(65) Prior Publication Data

US 2015/0235792 A1 Aug. 20, 2015

(30) Foreign Application Priority Data

Feb. 19, 2014 (JP) ..... 2014-029784

(51) Int. Cl.
*H01H 51/22* (2006.01)
*H01H 50/56* (2006.01)

(52) U.S. Cl.
CPC ..... *H01H 50/56* (2013.01)

(58) Field of Classification Search
CPC ..... H01H 50/642
USPC ..... 335/129, 83
See application file for complete search history.

(56) References Cited

U.S. PATENT DOCUMENTS 2,077,091 A * 4/1937 Brander ..... H01H 50/56 200/1 A
3,824,511 A 7/1974 Aidn et al.
4,027,131 A 5/1977 Aidn et al.
4,616,201 A * 10/1986 Nagamoto ..... H01H 50/041 335/107
5,909,162 A 6/1999 Ikeda et al.
6,661,320 B1 * 12/2003 Fausch ..... H01H 50/002 335/129
6,771,153 B2 * 8/2004 Mochizuki ..... H01H 50/24 335/128

(Continued)

FOREIGN PATENT DOCUMENTS

CN 1409342 A 4/2003
CN 1877770 A 12/2006

(Continued)

OTHER PUBLICATIONS

Patent Abstracts of Japan, Publication No. 05-242753, published Sep. 21, 1993.

(Continued)

*Primary Examiner* — Alexander Talpalatski
(74) *Attorney, Agent, or Firm* — Staas & Halsey LLP

(57) ABSTRACT

An electromagnetic relay includes: an electromagnet; a twin contact set that includes first twin contacts provided on a first movable spring, and second twin contacts that are provided on a first fixed contact plate and disposed opposite to the first twin contacts; a single contact set that includes a first single contact provided on a second movable spring, and a second single contact that is provided on a second fixed contact plate and disposed opposite to the first single contact; and a card that moves in response to excitation or non-excitation of the electromagnet, and moves the first and the second movable springs simultaneously with the movement of the card.

8 Claims, 11 Drawing Sheets

(56) References Cited

U.S. PATENT DOCUMENTS

| | | | | |
|---|---|---|---|---|
| 6,906,604 | B1 * | 6/2005 | Mader | H01H 50/642 335/128 |
| 7,504,915 | B2 * | 3/2009 | Takayama | H01H 50/24 335/128 |
| 7,633,363 | B2 * | 12/2009 | Fausch | H01H 50/026 335/124 |
| 8,841,979 | B2 * | 9/2014 | Uchida | H01H 1/54 335/131 |
| 9,093,239 | B2 * | 7/2015 | Kato | H01H 50/54 |
| 2003/0062976 | A1 | 4/2003 | Mochizuki | |
| 2003/0085784 | A1 * | 5/2003 | Weber | H01H 50/541 335/129 |
| 2006/0279384 | A1 | 12/2006 | Takayama et al. | |
| 2011/0241809 | A1 * | 10/2011 | Sugisawa | H01H 1/54 335/188 |
| 2013/0222084 | A1 * | 8/2013 | Kato | H01H 50/043 335/189 |

FOREIGN PATENT DOCUMENTS

| | | |
|---|---|---|
| CN | 103189952 | 7/2013 |
| DE | 3625706 A1 | 2/1988 |
| FR | 2 811 470 | 1/2002 |
| JP | 5-242753 | 9/1993 |
| JP | 9-231896 | 9/1997 |
| JP | 11-339623 | 12/1999 |
| JP | 2000-149748 | 5/2000 |

OTHER PUBLICATIONS

Patent Abstracts of Japan, Publication No. 2000-149748, published May 30, 2000.

Patent Abstracts of Japan, Publication No. 11-339623, published Dec. 10, 1999.

Patent Abstracts of Japan, Publication No. 09-231896, published Sep. 5, 1997.

Espacenet English Abstract of German Publication No. 3625706 A1, Published Feb. 11, 1988.

Espacenet English Abstract of French Publication No. 2 811 470, Published Jan. 11, 2002.

Extended European Search Report dated Jul. 16, 2015 in corresponding European Patent Application No. 15152910.4.

Chinese Office Action dated Jul. 1, 2016 in corresponding Chinese Patent Application No. 201510083325.5.

Chinese Office Action dated Aug. 16, 2017 for corresponding Chinese Patent Application No. 201510083325.5.

Espacenet English Abstract for Chinese Patent Application Publication No. 103189952, dated Jul. 3, 2013.

* cited by examiner

ELECTROMAGNETIC RELAY

CROSS-REFERENCE TO RELATED APPLICATION

This application is based upon and claims the benefit of priority of the prior Japanese Patent Application No. 2014-029784 filed on Feb. 19, 2014, the entire contents of which are incorporated herein by reference.

FIELD

A certain aspect of the embodiments is related to an electromagnetic relay.

BACKGROUND

Conventionally, there has been known a relay including a contact spring and a fixed contact plate (see Japanese Laid-open Patent Publication No. 5-242753). In the relay, a tip of the contact spring is divided into two parts, and twin contacts are provided on the divided two parts, respectively. A single contact is provided on a base end of the contact spring. Fixed contacts are provided on positions on the fixed contact plate opposite to the twin contacts and the single contact, respectively.

Moreover, there has been conventionally known a relay that can mount either twin contacts or a single contact on a fixed contact piece and a movable contact piece (see Japanese Laid-open Patent Publication No. 2000-149748).

SUMMARY

According to an aspect of the present invention, there is provided an electromagnetic relay including: an electromagnet; a twin contact set that includes first twin contacts provided on a first movable spring, and second twin contacts that are provided on a first fixed contact plate and disposed opposite to the first twin contacts; a single contact set that includes a first single contact provided on a second movable spring, and a second single contact that is provided on a second fixed contact plate and disposed opposite to the first single contact; and a card that moves in response to excitation or non-excitation of the electromagnet, and moves the first and the second movable springs simultaneously with the movement of the card.

The object and advantages of the invention will be realized and attained by means of the elements and combinations particularly pointed out in the claims.

It is to be understood that both the foregoing general description and the following detailed description are exemplary and explanatory and are not restrictive of the invention, as claimed.

DESCRIPTION OF EMBODIMENTS

A relay sometimes includes two or more contact sets each of which is composed of the fixed contact and the movable contact. In this case, the two contact sets have the same specifications. That is, when each of the fixed contact and the movable contact included in one contact set is the twin contacts, each of the fixed contact and the movable contact included in the other contact set is also the twin contacts. Alternatively, when each of the fixed contact and the movable contact included in one contact set is the single contact, each of the fixed contact and the movable contact included in the other contact set is also the single contact.

In this case, a high load and a low load cannot be handled with only a single relay at the same time. A single contact can handle the high load, but cannot handle the low load. On the other hand, the twin contacts can handle the low load, but cannot handle the high load.

A description will now be given of embodiments with reference to the drawings.

Figure 1A:
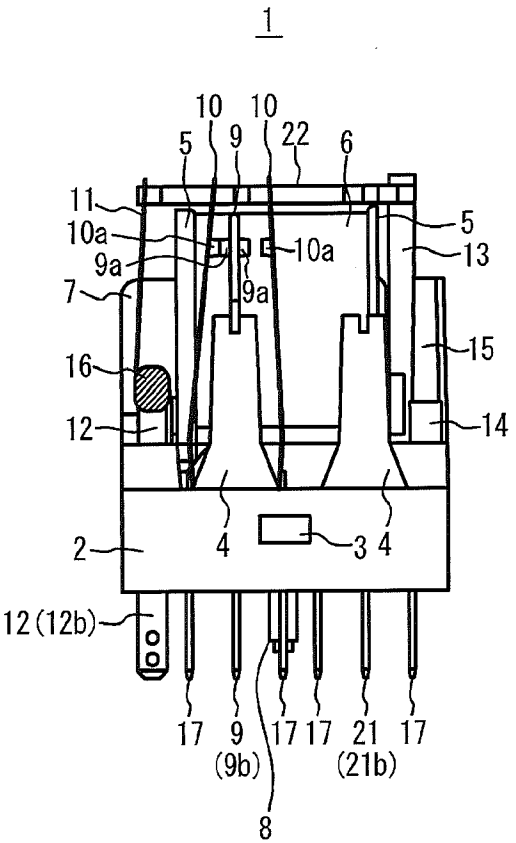
FIGS. 1A to 1C are diagrams illustrating the schematic configuration of an electromagnetic relay 1 according to a present embodiment.
Figure 1B:
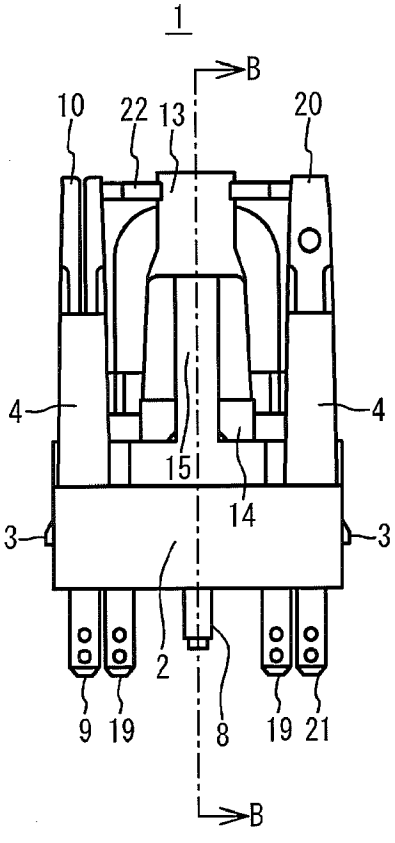
Figure 1C:
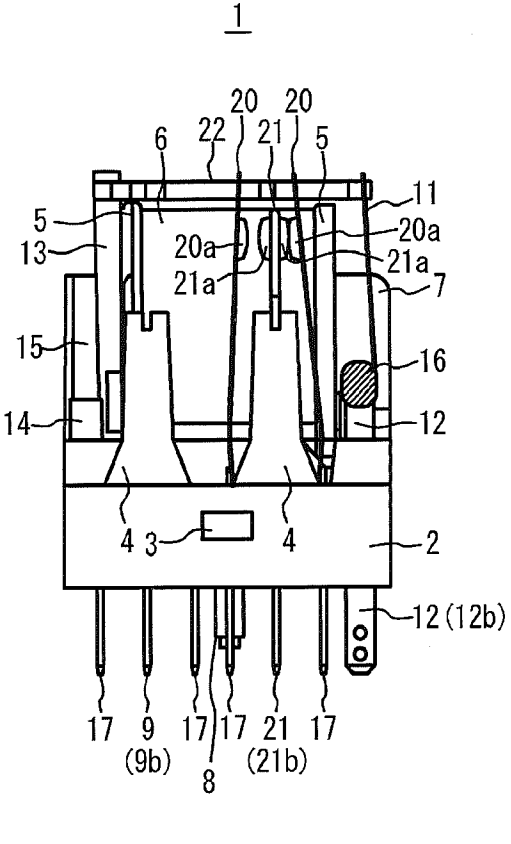

FIGS. 1A to 1C are diagrams illustrating the schematic configuration of an electromagnetic relay 1 according to a present embodiment. FIG. 1A illustrates a left side face of the electromagnetic relay 1. FIG. 1B illustrates a front face of the electromagnetic relay 1. FIG. 1C illustrates a right side face of the electromagnetic relay 1.

The electromagnetic relay 1 includes a fixing mold 2 corresponding to a frame, a spool 5, a coil 6, an iron core 7, movable springs 10 and 20, fixed contact plates 9 and 21, a return spring 11, a coil terminal 12, an armature 13, a hinge spring 14, a movable terminal 17 and a card 22. The movable springs 10 and 20 are plate springs, and the fixed contact plates 9 and 21 are metal such as brass.

Figure 2:
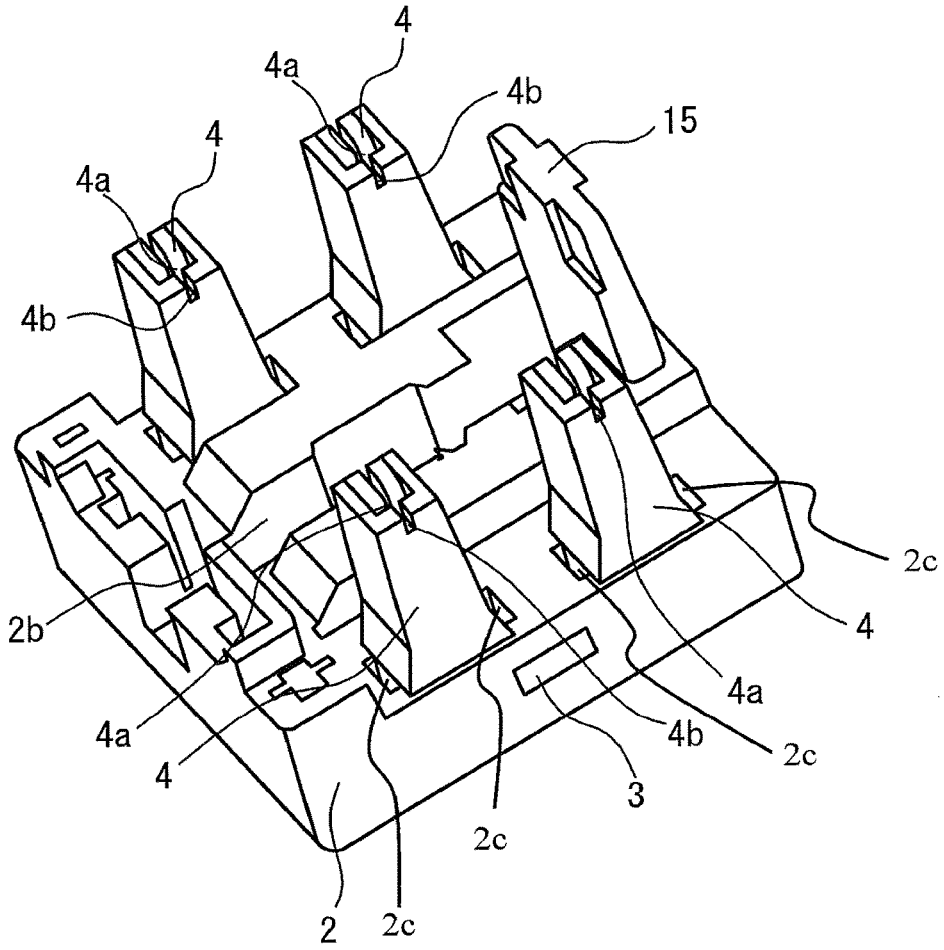
FIG. 2 is a diagram illustrating the schematic configuration of a fixing mold 2.

Protrusions 3 for attaching a cover, not shown, are formed on the left and the right side faces of the fixing mold 2. FIG. 2 illustrates the schematic configuration of the fixing mold 2. The fixing mold 2 is made of a resin or the like, and includes four projecting units 4 that can attach either the fixed contact plate 9 or 21. An insertion slot 4*a* for inserting the fixed contact plate 9 or 21 is formed on an upper part of each of the projecting units 4. Moreover, a groove 4*b* is formed on the upper part of each of the projecting units 4 so that a part of the fixed contact plate 9 or 21 contacts the upper part of each of the projecting units 4. Then, the fixing mold 2 includes a regulating unit 15 that extends upward and regulates the movement of the armature 13. Moreover, a groove 2*b* for placing the spool 5, the coil 6 and the iron core 7 which constitute an electromagnet is formed on the fixing mold 2. Here, a hole, a slot and a rib for mounting respective parts are properly formed on the fixing mold 2.

In FIG. 1A, the fixed contact plate 9 is inserted into one of the projecting units 4 (i.e., the projecting unit 4 of the left side). Then, a pair of the movable springs 10 (i.e., two movable springs 10) is provided on both sides of the fixed contact plate 9 so as to be opposite to the fixed contact plate 9. In FIG. 10, the fixed contact plate 21 is inserted into one of the projecting units 4 (i.e., the projecting unit 4 of the right side). Then, a pair of the movable springs 20 (i.e., two movable springs 20) is provided on both sides of the fixed contact plate 21 so as to be opposite to the fixed contact plate 21. As illustrated in FIGS. 1A and 1C, upper ends of the movable springs 10 and 20 contact the card 22. Holes 2*c* for inserting the pair of movable springs 10 or 20 are formed on right and left sides of each of the projecting units 4 (see FIG. 2).

Figure 3A:
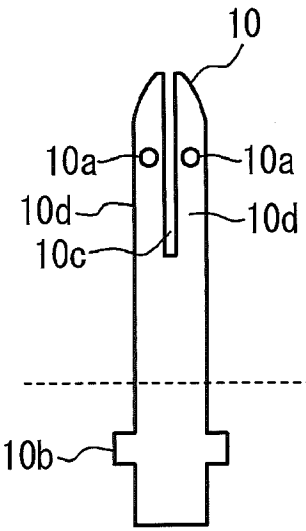
FIG. 3A is a diagram illustrating the schematic configuration of a movable spring 10.
Figure 3B:
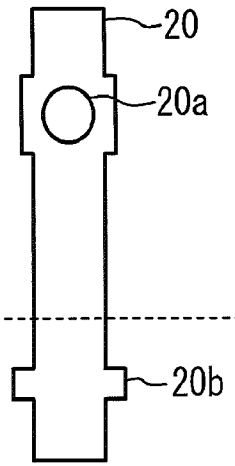
FIG. 3B is a diagram illustrating the schematic configuration of a movable spring 20.
Figure 3C:
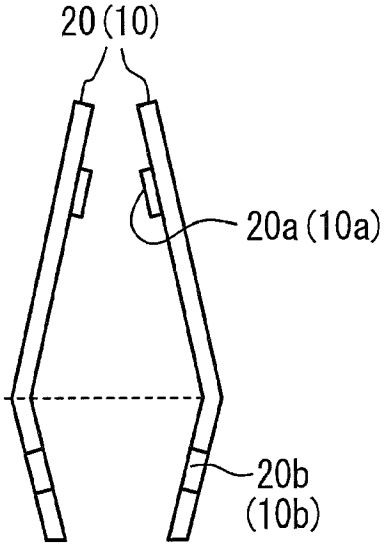
FIG. 3C is a side view of a pair of movable springs 10 and 20.
Figure 3D:
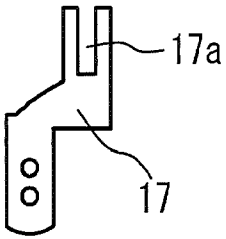
FIG. 3D is a diagram illustrating the schematic configuration of a movable terminal 17.
Figure 4A:
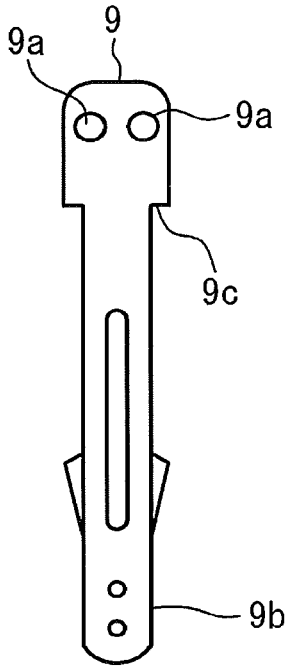
FIG. 4A is a diagram illustrating the schematic configuration of a fixed contact plate 9.
Figure 4B:
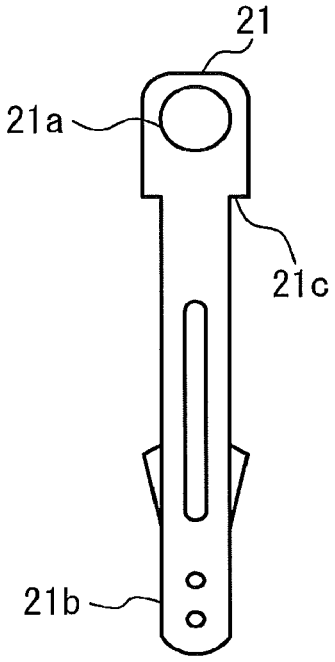
FIG. 4B is a diagram illustrating the schematic configuration of a fixed contact plate 21.

FIG. 3A illustrates the schematic configuration of the movable spring 10, and FIG. 3B illustrates the schematic configuration of the movable spring 20. FIG. 3C is a side view of the pair of movable springs 10 and 20. FIG. 3D illustrates the schematic configuration of the movable terminal 17. FIGS. 4A and 4B illustrate the fixed contact plates 9 and 21, respectively.

As illustrated in FIG. 3A, a cut 10*c* is formed near the upper end of the movable spring 10, and two spring elements 10*d* are formed. Contacts 10*a* (hereinafter, each contact thereof is also referred to as "a twin contact") constituting twin contacts are provided on the respective spring elements 10*d*. The twin contacts 10*a* are contacts for handling a low load (e.g. a load of a control system which processes an electric current of 10 mA). Even if the twin contact 10*a* provided on one of the spring elements 10*d* and a fixed contact mentioned later fails, contact with the fixed contact can be maintained by the twin contact 10*a* provided on the other one of the spring elements 10*d*. Therefore, in the case of the low load in which the contact failure between the contacts becomes a problem, the twin contacts 10*a* can secure reliability of the contact. Moreover, a stopper 10*b* that contacts the fixing mold 2 and regulates a limit location of the insertion of the movable spring 10 is formed near a lower end of the movable spring 10.

As illustrated in FIG. 3B, a single contact 20*a* is provided near the upper end of the movable spring 20. The single contact 20*a* is a contact for handling a high load (e.g. a load of a power supply system which processes an electric current of 5 A). Since the single contact 20*a* is larger than the movable spring 10, the single contact 20*a* prevents the contacts from being welded and being worn away at the time of the high load, and is excellent in the durability. Therefore, the single contact 20*a* can secure reliability of the contact in the case of the high load. Moreover, a stopper 20*b* that contacts the fixing mold 2 and regulates a limit position of the insertion of the movable spring 20 is formed near a lower end of the movable spring 20.

As illustrated in FIG. 3C, the movable springs 10 and 20 are bent at positions (i.e. positions illustrated by a dotted line) located slightly above the stoppers 10*b* and 20*b* so as to come close to the fixed contact plates 9 and 21, respectively.

The movable springs 10 and 20 are inserted from above the projecting units 4, but the movable terminal 17 of FIG. 3D is press-fitted from the bottom face of the fixing mold 2. At this time, each of the lower ends of the movable springs 10 and 20 is put between peripheral parts of a cut 17*a* of the movable terminal 17, and the movable springs 10 and 20 are electrically connected to the movable terminal 17.

The fixed contact plate 9 includes two twin contacts 9*a* that contact the twin contacts 10*a* of the movable spring 10 of FIG. 3A. As illustrated in FIG. 1A, the twin contacts 9*a* are formed on each of front and rear faces of the fixed contact plate 9. Therefore, the pair of movable springs 10 and the fixed contact plate 9 form two switches of a normally-on switch and a normally-off switch. The normally-on switch means a switch that is in an on-state by contacting one contact with another contact when no coil voltage is applied. The normally-off switch means a switch that is in an off-state by separating one contact from another contact when no coil voltage is applied. Thus, in the present embodiment, the two switches of the normally-on switch and the normally-off switch can be provided for one projecting unit 4. Here, only the pair of movable springs 10 and the fixed contact plate 9 constituting the normally-on switch, or only the pair of movable springs 10 and the fixed contact plate 9 constituting the normally-off switch may be provided for one projecting unit 4 according to a using way of the electromagnetic relay.

The fixed contact plate 21 of FIG. 4B includes a single contact 21*a* that contacts a single contact 20*a* of the movable spring 20 of FIG. 3B. As illustrated in FIG. 1C, the single contact 21*a* are formed on each of front and rear faces of the fixed contact plate 21. Therefore, the pair of movable springs 20 and the fixed contact plate 21 form two switches of a normally-on switch and a normally-off switch. Only the pair of movable springs 20 and the fixed contact plate 21 constituting the normally-on switch, or only the pair of movable springs 20 and the fixed contact plate 21 constituting the normally-off switch may be provided for one projecting unit 4.

Since the fixed contact plate 9 is formed integrally to a fixed terminal 9*b* from a position where the twin contact 9*a* is provided, the fixed terminal 9*b* is exposed from the bottom of the fixing mold 2 by inserting the fixed contact plate 9 from the projecting unit 4, as illustrated in FIG. 1A. In this case, a jaw part 9*c* of the fixed contact plate 9 contacts the groove 4*b* of the projecting unit 4. Similarly, since the fixed contact plate 21 is formed integrally to a fixed terminal 21*b* from a position where the single contact 21*a* is provided, the fixed terminal 21*b* is exposed from the bottom of the fixing mold 2 by inserting the fixed contact plate 21 from the projecting unit 4, as illustrated in FIG. 1C. In this case, a jaw part 21*c* of the fixed contact plate 21 contacts the groove 4*b* of the projecting unit 4.

Figure 5A:
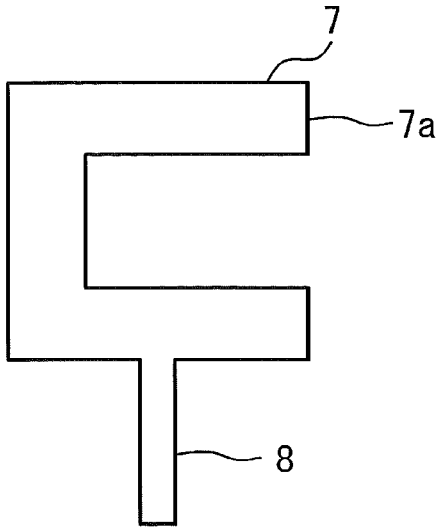
FIG. 5A is a diagram illustrating the schematic configuration of an iron core 7.
Figure 5B:
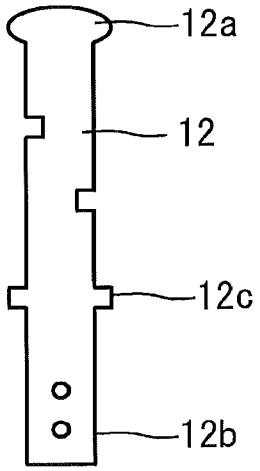
FIG. 5B is a diagram illustrating the schematic configuration of a coil terminal 12.
Figure 5C:
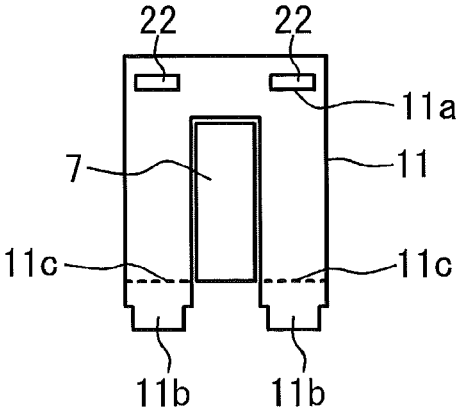
FIG. 5C is a diagram illustrating the schematic configuration of a return spring 11.
Figure 6A:
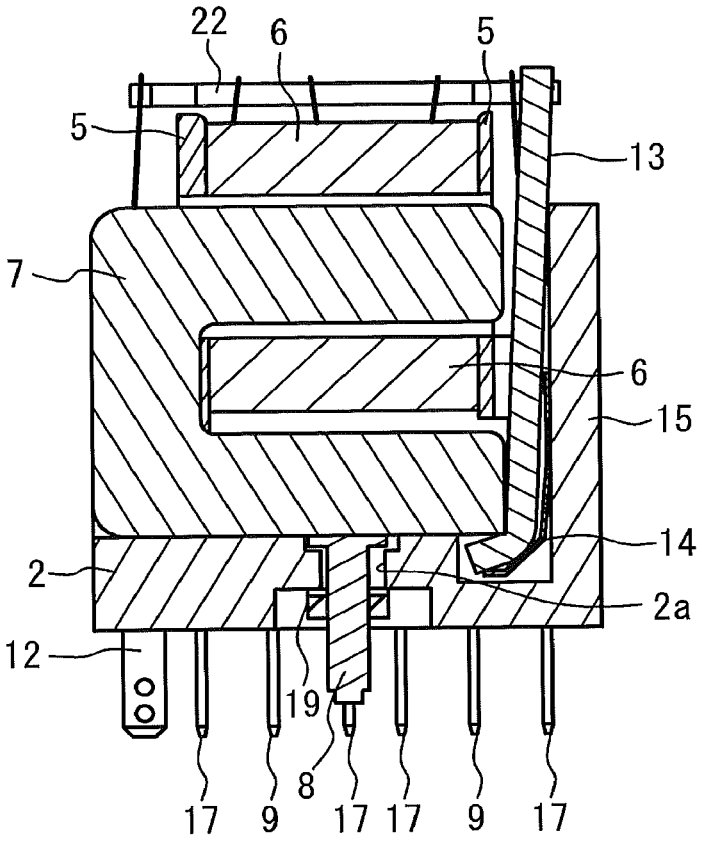
FIG. 6A is a sectional view of the electromagnetic relay 1 taken along a line B-B in FIG. 1B.
Figure 6B:
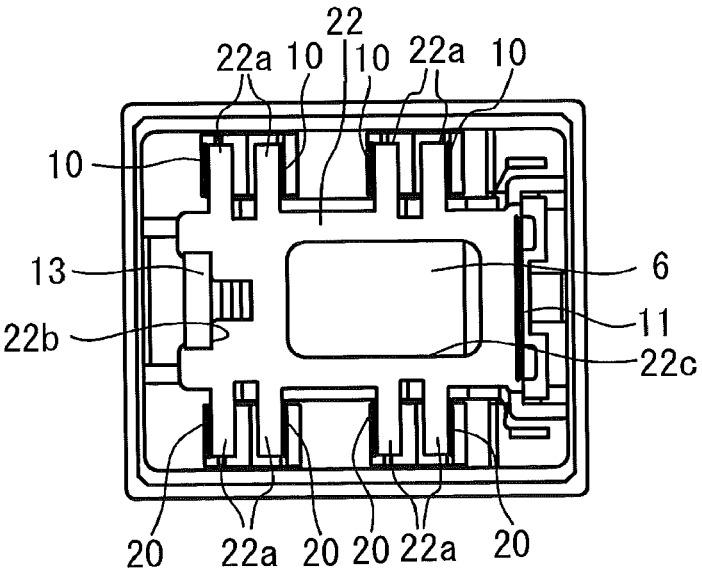
FIG. 6B is a diagram of the electromagnetic relay 1 as seen from above.

FIG. 5A is a diagram illustrating the schematic configuration of the iron core 7. FIG. 5B is a diagram illustrating the schematic configuration of the coil terminal 12. FIG. 5C is a diagram illustrating the schematic configuration of the return spring 11. FIG. 6A is a sectional view of the electromagnetic relay 1 taken along a line B-B in FIG. 1B. FIG. 6B is a diagram of the electromagnetic relay 1 as seen from above. In FIG. 6B, two pairs of the movable springs 10 and two pairs of the movable springs 20 are provided.

As illustrated in FIGS. 5A and 6A, the iron core 7 is almost a U-shape, and one end 7*a* of the iron core 7 (i.e., an end portion of an upper side of the iron core 7) is inserted into a central portion of the spool 5. A screw unit 8 extending vertically downward is provided on the iron core 7. The screw unit 8 is exposed to the outside via a through-hole 2*a* provided on the center of the fixing mold 2. The screw unit 8 exposed to the outside is fixed to the fixing mold 2 by a screw 19. That is, the iron core 7 is fixed to the fixing mold 2.

The coil terminal 12 illustrated in FIG. 5B includes a head portion 12*a*, a terminal portion 12*b* and a stopper 12*c*. The coil terminal 12 is inserted into a through-hole, not shown, of the fixing mold 2 from above the projecting unit 4. At this time, the terminal portion 12*b* of the coil terminal 12 is exposed from the fixing mold 2, as illustrated in FIGS. 1A and 1C. Moreover, the stopper 12*c* that regulates a limit position of the insertion of the coil terminal 12 is formed on the coil terminal 12. In the coil terminal 12, the coil 6 is wound on the head portion 12*a*, and is fixed thereto by a solder 16. Thereby, the coil terminal 12 is electrically connected to the coil 6.

The return spring 11 illustrated in FIG. 5C has almost a U-shape so as to cover the iron core 7. Two through-holes 11*a* in which a part of card 22 is fitted are formed on an upper part of the return spring 11. Thereby, the return spring 11 is coupled with the card 22, and pushes the card 22 toward the armature 13. Moreover, the return spring 11 includes fixed portions 11*b* for fixing the return spring 11 to the fixing mold 2. In the return spring 11, leg portions 11*c* are bent at a position of a dotted line to push the card 22 toward the armature 13.

As illustrated in FIGS. 6A and 1A, the armature 13 is provided between the iron core 7 and the regulating unit 15, and the hinge spring 14 is provided between the armature 13 and the regulating unit 15. As illustrated in FIGS. 6A and 6B, an upper end of the armature 13 is fixed to the card 22.

As illustrated in FIG. 6B, the card 22 is formed with almost a rectangular flat plate, and an opening 22*c* which exposes the coil 6 is formed on the center of the card 22. A concave portion 22*b* for fixing the armature 13 is formed on a rear face side (i.e., a left side of FIG. 6B) of the card 22. In addition, in the card 22, two pairs of projections 22*a* are projected from each of the right and the left side faces of the flat plate. A space is formed between each pair of projections 22*a*. The movable springs 10 contact the respective outsides from the spaces of the two pairs of projections 22*a* on the right side face (i.e., an upper side of FIG. 6B). The movable springs 20 contact the respective outsides from the spaces of the two pairs of projections 22*a* on the left side face (i.e., a lower side of FIG. 6B).

Figure 7A:
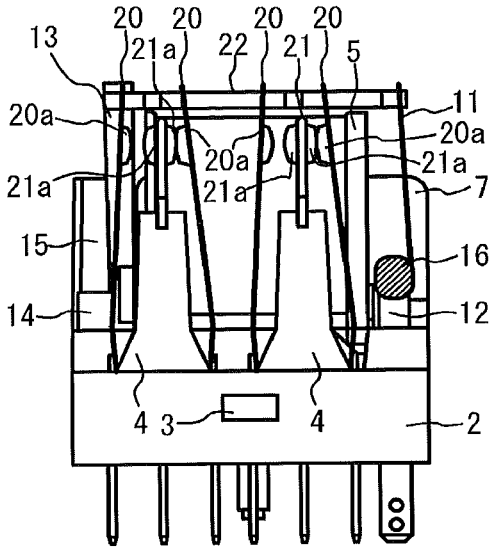
FIG. 7A is a diagram illustrating a non-operation state of the electromagnetic relay 1.
Figure 7B:
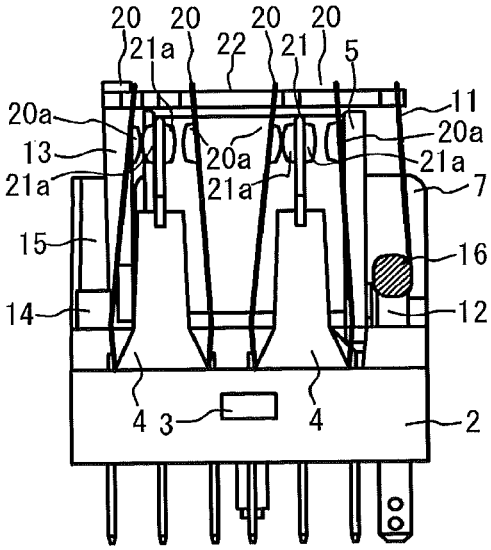
FIG. 7B is a diagram illustrating an operation state of the electromagnetic relay 1.

FIG. 7A is a diagram illustrating a non-operation state of the electromagnetic relay 1. FIG. 7B is a diagram illustrating an operation state of the electromagnetic relay 1. In the states illustrated in FIGS. 7A and 7B, the fixed contact plate 21 is provided on each of two projecting units 4. Here, also when the movable springs 10 and the fixed contact plates 9 are provided on the projecting units 4, the operation like FIGS. 7A and 7B is performed.

First, in the non-operation state of FIG. 7A (i.e., in a case where an electromagnet is not excited), the iron core 7 does not attract the armature 13 by an electromagnetic force, and the return spring 11 pushes the card 22 in a left direction of FIG. 7A. Thereby, the armature 13 is pushed in the left direction of FIG. 7A by the card 22, and contacts the regulating unit 15. Moreover, the respective movable springs 20 in which the upper ends contact the card 22 are moved in the left direction of FIG. 7A. Thereby, the contact 20*a* on the movable spring 20, in the pair of movable springs 20, located on a right side of the fixed contact plate 21 contacts the contact 21*a* of the fixed contact plate 21, and the contact 20*a* on the movable spring 20 located on a left side of the fixed contact plate 21 does not contact the contact 21*a*.

Next, in the operation state of FIG. 7B, a voltage is applied to the coil 6 and the electromagnet is excited. Therefore, the armature 13 is attracted to the iron core 7 by the electromagnetic force, and moves in a right direction of FIG. 7B from the state of FIG. 7A. Thereby, the armature 13 pushes the card 22 in the right direction of FIG. 7B. At this time, the movable springs 20 in which the upper ends contact the card 22 are moved in the right direction of FIG. 7B. Thereby, the contact 20*a* on the movable spring 20, in the pair of movable springs 20, located on the left side of the fixed contact plate 21 contacts the contact 21*a* of the fixed contact plate 21, and a contact state between the contact 21*a* and the contact 20*a* on the movable spring 20 located on the right side of the fixed contact plate 21 is released.

Thus, when the voltage is not applied to the coil 6, the electromagnetic relay 1 becomes the non-operation state of FIG. 7A. When the voltage is applied to the coil 6, the electromagnetic relay 1 becomes the operation state of FIG. 7B. When on/off of the voltage to be applied to the coil 6 is switched, the operation state of FIG. 7B and the non-operation state of FIG. 7A are alternately switched.

Figure 8A:
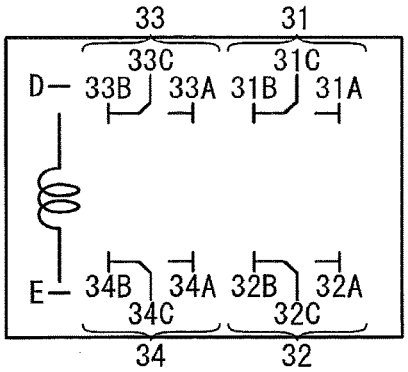
FIG. 8A is a diagram schematically illustrating the circuit configuration of the electromagnetic relay 1.
Figure 8B:
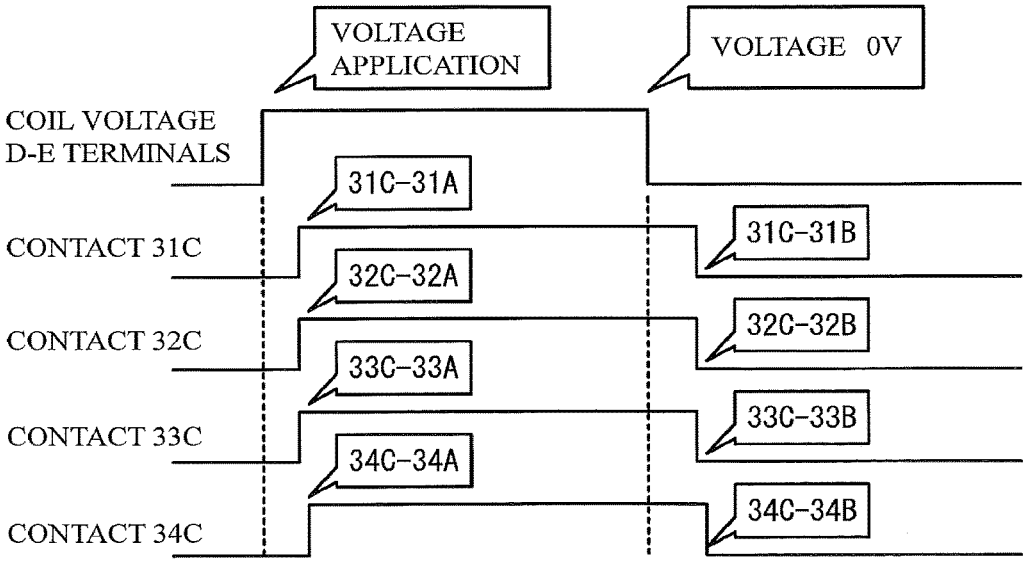
FIG. 8B is a time chart illustrating the operation of the electromagnetic relay 1.

FIG. 8A is a diagram schematically illustrating the circuit configuration of the electromagnetic relay 1. FIG. 8B is a time chart illustrating the operation of the electromagnetic relay 1.

As illustrated in FIG. 8A, the electromagnetic relay 1 includes four switch sets 31 to 34, and coil terminals D and E. Here, the number of switch sets included in the electromagnetic relay 1 is not limited to four.

Each of the coil terminals D and E corresponds to the above-mentioned coil terminals 12. Each of the switch sets 31 to 34 has three contacts composed of two movable contacts and a single fixed contact, and forms the two switches of the normally-on switch and the normally-off switch. For example, the switch set 31 includes two movable contacts 31A and 31B, and a single fixed contact 31*c*, constitutes the normally-on switch by the contacts 31C and 31B, and constitutes the normally-off switch by the contacts 31C and 31A.

Each of the switch sets 31 to 34 corresponds to any one of a set of the twin contacts 10*a* on the pair of movable springs 10 and the twin contacts 9*a* on the fixed contact plate 9 disposed between the movable springs 10, or a set of the single contacts 20*a* on the pair of movable springs 20 and the single contacts 21*a* on the fixed contact plate 21 disposed between the movable springs 20.

When the switch set 31 corresponds to the set of the twin contacts 10*a* on the pair of movable springs 10 and the twin contacts 9*a* on the fixed contact plate 9 disposed between the movable springs 10, for example, the contact 31*c* corresponds to the twin contacts 9*a* on the fixed contact plate 9, and each of the contacts 31A and 31B corresponds to the twin contacts 10*a* on the pair of movable springs 10. When the switch set 32 corresponds to the set of the single contacts 20*a* on the pair of movable springs 20 and the single contacts

21*a* on the fixed contact plate 21 disposed between the movable springs 20, for example, the contact 32C corresponds to the single contacts 21*a* on the fixed contact plate 21, and each of the contacts 31A and 31B corresponds to the single contacts 20*a* on the pair of movable springs 20.

In a state where the voltage is not applied between the coil terminals D and E of FIG. 8B, the contacts 31C, 32C, 33C and 34C contact the contacts 31B, 32B, 33B and 34B, respectively. When the voltage is applied between the coil terminals D and E (i.e., the coil terminals 12), as illustrated in FIG. 8B, the armature is attracted to the electromagnet, the card is moved and hence the movable springs are moved according to the movement of the card. Therefore, after a constant time lag, contacts to be connected to the contacts 31C, 32C, 33C and 34C are simultaneously switched from the contacts 31B, 32B, 33B and 34B to the contacts 31A, 32A, 33A and 34A, respectively. When the voltage to be applied between the coil terminals D and E becomes 0V, the card moves by a biasing force of the return spring, and after a constant time lag, the contacts to be connected to the contacts 31C, 32C, 33C and 34C are simultaneously switched from the contacts 31A, 32A, 33A and 34A to the contacts 31B, 32B, 33B and 34B, respectively. Thereby, the plurality of switches can be switched simultaneously, and it is possible to handle a plurality of loads at the same time by forming contact configuration of each switch so as to be suited for a desired load. For example, when the switch sets 31 to 34 include the pair of movable springs 10 and the fixed contact plate 9 disposed between the movable springs 10, and the pair of movable springs 20 and the fixed contact plate 21 disposed between the movable springs 20, it is possible to handle the high load and the low load at the same time.

The electromagnetic relay 1 of FIGS. 1A and 1C has a twin contact set that includes the twin contacts 10*a* on the pair of movable springs 10 and the twin contacts 9*a* on the fixed contact plate 9 disposed between the movable springs 10, and a single contact set that includes the single contacts 20*a* on the pair of movable springs 20 and the single contacts 21*a* on the fixed contact plate 21 disposed between the movable springs 20. However, each of the number of twin contact sets and the number of single contact sets is not limited to one.

Figure 9A:
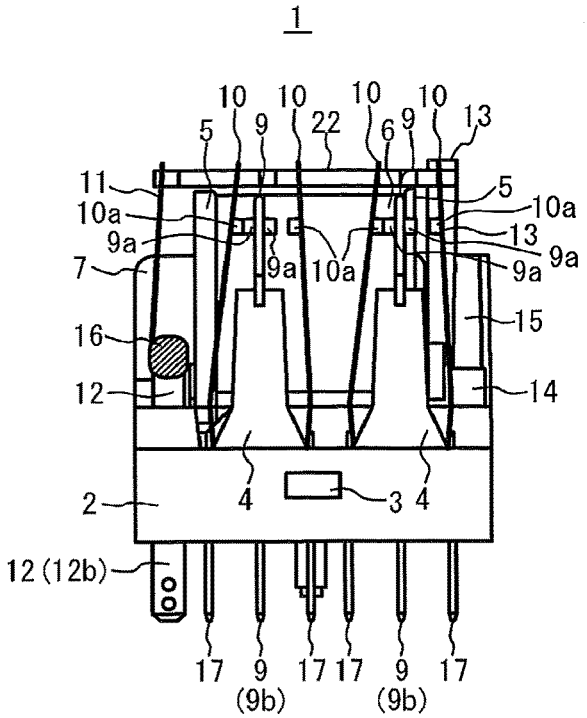
FIG. 9A is a left side view of the electromagnetic relay 1 according to a first variation example.
Figure 9B:
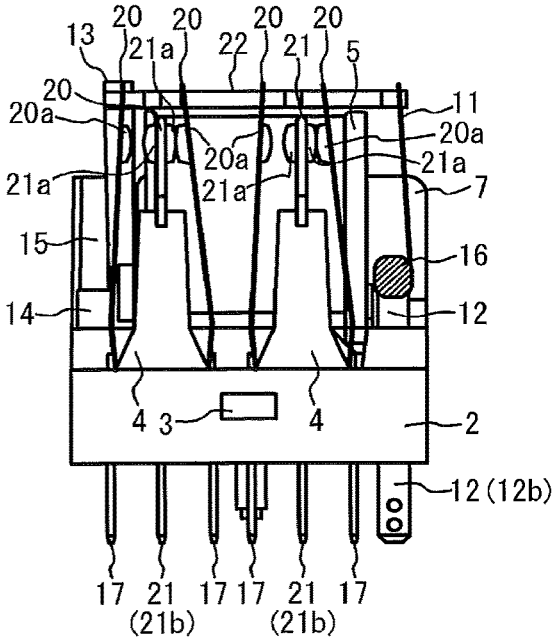
FIG. 9B is a right side view of the electromagnetic relay 1 according to a first variation example.
Figure 10A:
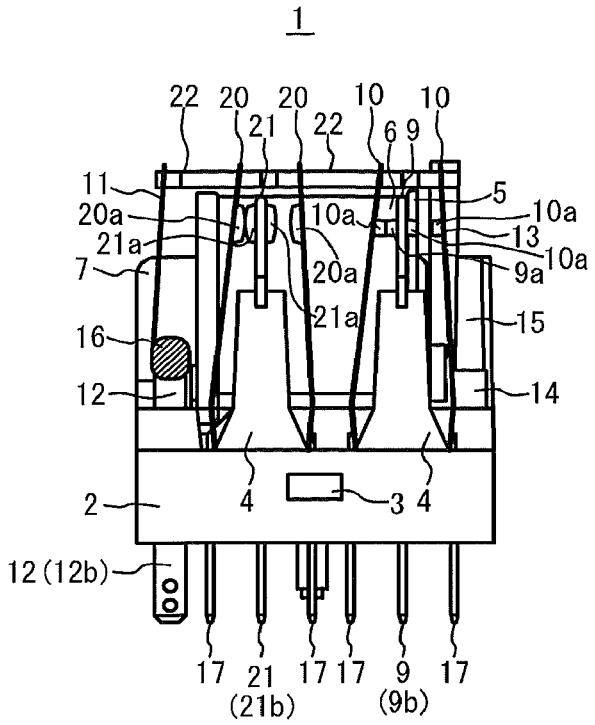
FIG. 10A is a left side view of the electromagnetic relay 1 according to a second variation example.
Figure 10B:
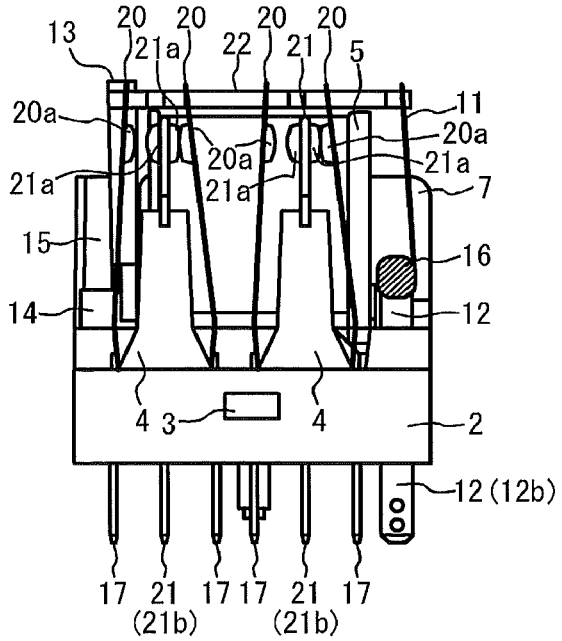
FIG. 10B is a right side view of the electromagnetic relay 1 according to a second variation example.
Figure 11A:
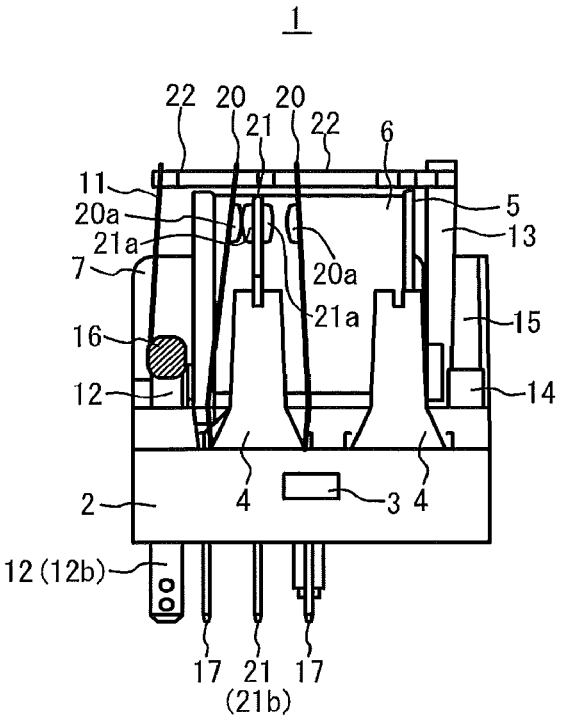
FIG. 11A is a left side view of the electromagnetic relay 1 according to a third variation example.
Figure 11B:
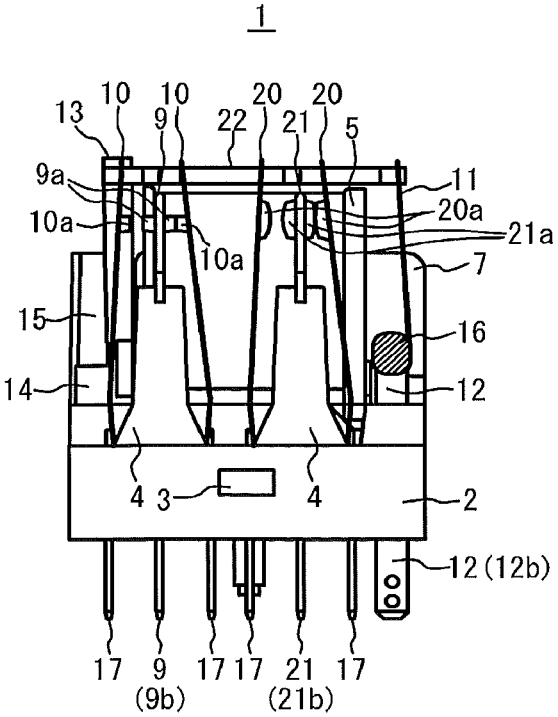
FIG. 11B is a right side view of the electromagnetic relay 1 according to a third variation example.

For example, the electromagnetic relay 1 may include two twin contact sets and two single contact sets, as illustrated in FIGS. 9A and 9B. Moreover, the electromagnetic relay 1 may include one twin contact set and three single contact sets, as illustrated in FIGS. 10A and 10B. On the contrary, the electromagnetic relay 1 may include three twin contact sets and one single contact set. In addition, the electromagnetic relay 1 may include one twin contact set and two single contact sets, as illustrated in FIGS. 11A and 11B. On the contrary, the electromagnetic relay 1 may include two twin contact sets and one single contact set. In this case, the fixed contact plate 9 or 21 is not provided on one of the projecting units 4.

Moreover, the number of the projecting units 4 included in the fixing mold 2 is not limited to four. The fixing mold 2 needs to include at least two projecting units 4. Although in the present embodiment, the plurality of projecting units 4 are disposed so as to be opposite to the right and the left side faces of the electromagnet, the plurality of projecting units 4 may be disposed so as to be opposite to only one of the right and the left side faces of the electromagnet.

According to the present embodiment, the electromagnetic relay 1 includes: the electromagnet composed of the spool 5, the coil 6 and the iron core 7; the twin contact set that includes the twin contacts 10*a* provided on the movable spring 10, and the twin contacts 9*a* that are provided on the fixed contact plate 9 and disposed opposite to the twin contacts 10*a*; the single contact set that includes the single contact 20*a* provided on the movable spring 20, and the single contact 21*a* that is provided on the fixed contact plate 21 and disposed opposite to the single contact 20*a*; and the card 22 that moves in response to the excitation or non-excitation of the electromagnet, and moves the movable springs 10 and 20 simultaneously with the movement of the card 22. Therefore, the electromagnetic relay 1 can simultaneously handle the high load (e.g. the load of the power supply system which processes the electric current of 5 A) and the low load (e.g. the load of the control system which processes the electric current of 10 mA), and can secure reliability of the contact.

Moreover, the electromagnetic relay 1 includes: the armature 13 that adjoins one end of the electromagnet in a longitudinal direction, and is attracted by the electromagnetic force of the electromagnet; the card 22 that is fixed to the armature 13 and includes a plurality of pairs of projections 22*a* extending toward the right and the left side faces of the electromagnet; and the return spring 11 that is opposite to another end of the electromagnet in the longitudinal direction, is coupled with the card 22, and biases the card 22 toward the armature 13; wherein the upper ends of the pair of movable springs 10 and the pair of movable springs 20 contact the plurality of pairs of projections 22*a*, and follow the movement of the card 22. Therefore, the twin contacts 10*a* on the pair of movable springs 10 and the single contacts 20*a* on the pair of movable springs 20 can be simultaneously turned on or off in accordance with the movement of the card 22.

All examples and conditional language recited herein are intended for pedagogical purposes to aid the reader in understanding the invention and the concepts contributed by the inventor to furthering the art, and are to be construed as being without limitation to such specifically recited examples and conditions, nor does the organization of such examples in the specification relate to a showing of the superiority and inferiority of the invention. Although the embodiments of the present invention have been described in detail, it should be understood that the various change, substitutions, and alterations could be made hereto without departing from the spirit and scope of the invention.

What is claimed is:

1. An electromagnetic relay comprising:

a base;

an elongated electromagnet having first and second opposite longitudinal sides, and first and second opposite ends;

a movable card spaced from and substantially parallel to the base and having first and second opposite longitudinal sides corresponding to the longitudinal sides of the electromagnet, and first and second opposing ends, wherein the electromagnet is positioned between the base and the card;

a plurality of first projections that are arranged in a row along a longitudinal direction of the electromagnet, each first projection extending from the base toward the card and being positioned at the first longitudinal side of the electromagnet;

a plurality of second projections that are arranged in a row along the longitudinal direction of the electromagnet, each second projection extending from the base toward the card and being positioned at the second longitudinal side of the electromagnet;

an armature that is opposite to the first end of the electromagnet, has one end rotatably fixed to the base, a second end, and is attracted by an electromagnetic force of the electromagnet;

a return spring that is opposite to the second end of the electromagnet, and has a first end fixed directly to the base and a second end received by the card, wherein the card is biased toward the armature by the return spring;

a twin contact set positioned at the first longitudinal side of the electromagnet and including first twin contacts provided on a first movable spring having a first end received in the base and a second end received in the first longitudinal side of the card, and second twin contacts that are provided on a first fixed contact plate received in the first projection, the second twin contacts being disposed opposite to the first twin contacts; and a single contact set positioned at the second longitudinal side of the electromagnet and including a first single contact provided on a second movable spring having a first end received in the base and a second end received in the second longitudinal side of the card, and a second single contact that is provided on a second fixed contact plate received in the second projection and that is disposed opposite to the first single contact, wherein the card moves parallel to the base via the armature being responsive to excitation of the electromagnet, and simultaneously moves the first and the second movable springs received therein.

2. The electromagnetic relay as claimed in claim 1, further comprising:

a third movable spring received by the base and having third twin contacts thereon and facing the first fixed contact plate having fourth twin contacts thereon; and a fourth movable spring received by the base and having a third single contact thereon and facing the second fixed contact plate having a fourth single contact thereon;

wherein the first and third twin contacts on the first and third movable springs, respectively, and the second and fourth twin contacts on the first fixed contact plate form a first normally-on switch and a first normally-off switch, the first and third single contacts on the second and fourth movable springs and the second and fourth single contacts on the second fixed contact plate form a second normally-on switch and a second normally-off switch, and the first normally-off switch and the second normally-off switch are simultaneously turned on in response to the excitation of the electromagnet, and the first normally-on switch and the second normally-on switch are simultaneously turned on in response to de-excitation of the electromagnet.

3. The electromagnetic relay as claimed in claim 2, wherein the card includes a plurality of projections extending along the first and second longitudinal sides thereof, and wherein the first, second, third and fourth movable springs contact, respectively, one of the plurality of projections, respectively, and follow the movement of the card.

4. The electromagnetic relay as claimed in claim 1, wherein each of the movable springs includes two spring elements on which the twin contacts are provided, respectively.

5. The electromagnetic relay as claimed in claim 4, wherein the base includes holes adjacent one of the first projections and one of the second projections for receiving, respectively, the first ends of each of the movable springs therein.

6. The electromagnetic relay as claimed in claim 5, wherein each of the movable springs includes a first stopper that limits insertion of each of the movable springs into each of the holes.

7. The electromagnetic relay as claimed in claim 4, wherein a cut is formed between the spring elements.

8. The electromagnetic relay as claims in claim 5, wherein each of the movable springs is bent near the first stopper so as to extend closer to the respective fixed contact plate.

* * * * *